United States Patent [19]

Boyes

[11] Patent Number: 4,626,138

[45] Date of Patent: Dec. 2, 1986

[54] NON-IMPACTING PILE DRIVER

[75] Inventor: G. Mitchell Boyes, Green Bay, Wis.

[73] Assignee: Atlas Hydropiling Ltd., Green Bay, Wis.

[21] Appl. No.: 732,676

[22] Filed: May 10, 1985

[51] Int. Cl.[4] ..... E02D 7/20

[52] U.S. Cl. ..... 405/232; 254/29 R; 405/230

[58] Field of Search ..... 405/196, 198, 228, 232, 405/230; 254/29 R

[56] References Cited

U.S. PATENT DOCUMENTS

| | | | |
|---|---|---|---|
| 2,982,103 | 5/1961 | Revesz et al. | 405/230 |
| 3,008,691 | 11/1961 | Steele et al. | 405/232 X |
| 3,332,663 | 7/1967 | Cargile | 405/198 X |
| 3,685,301 | 2/1972 | Heacox | 405/230 |
| 3,852,970 | 12/1974 | Cassidy | 405/230 |
| 3,869,003 | 3/1975 | Yamada et al. | 405/232 X |
| 4,051,685 | 10/1977 | Jansz | 405/228 |

*Primary Examiner*—David H. Corbin

*Attorney, Agent, or Firm*—James E. Nilles

[57] ABSTRACT

The non-impact pile driver of this invention comprises a mast mounted on a trailer chassis and a carriage guided by the mast for vertical motion along it and comprising a hydraulic ram with a downwardly projecting piston rod. The carriage is raised and controlledly lowered by means of a winch. Horizontally movable latch members on the carriage, operated by remotely controllable hydraulic actuators, engage abutments on the mast, at spaced intervals along it, to lock the carriage to the mast. Thus the carriage can be lowered in stages for driving a substantially long pile.

6 Claims, 9 Drawing Figures

NON-IMPACTING PILE DRIVER

FIELD OF THE INVENTION

This invention relates to a non-impacting pile driver suitable for use in underpinning an existing building as well a for driving piles for a building to be constructed; and the invention is more particularly concerned with a non-impacting pile driver suitable for driving piling sections of substantially long length.

BACKGROUND OF THE PRIOR ART

When a building has sunk due to poor underlying soil conditions, or failure of the foundation due to other causes, it can often be saved by raising it back to its original level. For this purpose piles must usually be driven into the ground under or adjacent to the foundation to provide a solid underpinning upon which force can be exerted for raising the sunken parts of the building and upon which the building is supported after repairs are completed.

U.S. Pat. No. 2,982,103 to Revesz et al discloses such a method of raising a building, wherein brackets are fastened to the sunken foundation wall at spaced locations along it and a hydraulic jack is mounted on each bracket. The jack is employed to drive a pile down alongside the foundation until the pile offers a predetermined resistance to further driving, the value of that resistance being determined by the load that the pile will be required to support. As the pile is driven down, the jack reacts between the foundation wall and the pile, which is to say that the building supports the upward reaction to the downward driving force that the jack exerts. When the pile reaches the desired depth, the bracket is connected to an upper end portion of it, so that the pile can then directly support the building and the jack can be removed for reuse. The connection between the bracket and the pile comprises a load plate that rests on the top of the pile and screw threaded connections between the load plate and the bracket whereby the weight of the building can be taken up at the same time that it is relieved from the hydraulic jack.

With the apparatus disclosed by this reference the jack necessarily has a somewhat limited stroke and the bracket on which it is mounted must be fairly close to the ground. As a result, the pile must be made up of a series of short sections that are coupled to one another as the pile is being driven. The patent specifies that the pile can be made up of pipe sections, each approximately four feet long. Such short sections of pipe tend to be relatively expensive per unit of length, since they usually have to be cut from longer standard lengths, and the cost of this composite pile is further increased by the numerous couplers needed for it. Further and very significant cost is, of course, involved in the labor and time required for connecting the short pipe sections as they are being driven.

U.S. Pat. No. 3,852,970, to Cassidy, discloses a generally similar arrangement wherein, however, the connection between the hydraulic jack and the bracket on the foundation wall provides for stepwise vertical adjustment of the jack to each of a number of locations. For such adjustment a pair of upright pipes are secured to the bracket in parallel, laterally spaced relation to one another, each having pin receiving holes at intervals along its length. A reaction block to which the upper end of the jack cylinder is fixed is adjustably secured at any desired position along the pipes by pins extending through it and into a hole in each of the pipes. With this arrangement the relatively short stroke of the jack can be effectively lengthened to a certain extent by bodily up and down adjustment of the jack cylinder, but it is still necessary to work with pile sections substantially shorter than standard length pile pipes and to devote time and labor to coupling these pile sections as they are being driven.

Conventional impact pile drivers can, of course, drive piling sections in standard lengths of about 25 ft. However, an impact pile driver is not suitable for use in underpinning an existing sunken building because of the severe damage to the building structure that is likely to result from its impact shocks, transmitted to the building through the ground. For that matter, there are situations where an impact pile driver cannot or should not be used to drive piles for a new building, as where it must operate near a laboratory or the like having instruments that would be adversely affected or destroyed by the vibrations and shocks that it produces, or near a hospital where its noise cannot be tolerated.

SUMMARY OF THE INVENTION

The general object of the present invention is to provide a pile driver of the non-impact type, capable of being used safely alongside a building that is structurally damaged, or near a laboratory or the like where impact shocks, vibration and noise cannot be tolerated, and capable of driving standard length sections of pile pipe.

It is also an object of this invention to provide a self-contained non-impact pile driver that can drive pilings in close proximity to the walls or footings of existing structures to provide for underpinning them, and which does not depend upon an existing building or set of pilings for reaction support, to thus be capable of operating at any desired distance from existing structures.

A further object of this invention is to provide a nonimpact pile driver with which pilings can be driven down to the point where they encounter a predetermined resistance and with which measurements of resistance can be readily made from time to time, as desired, while a pile is being driven.

Another and more specific object of this invention is to provide a non-impact pile driver comprising a large diameter long stroke ram and means whereby the ram can be moved down along a mast in steps as a pile is being driven and whereby the ram can be releasably locked to the mast at each step, all without need for the presence of an operator near the ram, thus affording a high degree of safety in the operation of the machine.

These and other objects of the invention that will appear as the description proceeds are achieved in the non-impacting pile driver of this invention, which comprises a chassis having ground engaging means for engaging the ground at a plurality of spaced points to provide a stable base, and a mast secured to the chassis and comprising a pair of laterally spaced opposite and upright guide rails. A carriage having opposite side portions that are slidably engaged with the guide rails is thereby confined to vertical movement along the mast. The carriage carries a hydraulic ram comprising a cylinder that is fixed to the carriage with its axis upright and between the guide rails and a piston rod projecting downward from the cylinder that is axially extendable and retractable relative to the cylinder and the carriage through a stroke of predetermined length. The pile driver further comprises latch means for releasably locking the carriage at each of a plurality of locations along the mast, comprising at least one latch member adjacent to each of said side portions of the carriage, each said latch member being movable horizontally to and from an extended position, and means on the mast defining a plurality of abutments adjacent to each guide rail, each said abutment being engageable by one of said latch members in the extended position of the latter to cooperate with the latch member in confining the carriage against upward displacement. The abutments adjacent to each guide rail are spaced along the same at distances shorter than the length of the piston rod stroke. Actuating means connected between the carriage and each of said latch members is arranged for actuating the latch members substantially in unison, alternatively and selectably to their extended positions or away from their extended positions to retracted positions in which they are clear of said abutments.

Preferably a winch is supported on the chassis and has a connection with the carriage, for raising and controlledly lowering the carriage when the latch members are in their retracted positions. It is also preferred that the chassis have a substantially flat top surface of substantial area upon which weights can be placed for resisting the upward reaction to downward force upon a pile that is exerted through the piston rod.

BRIEF DESCRIPTION OF THE DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
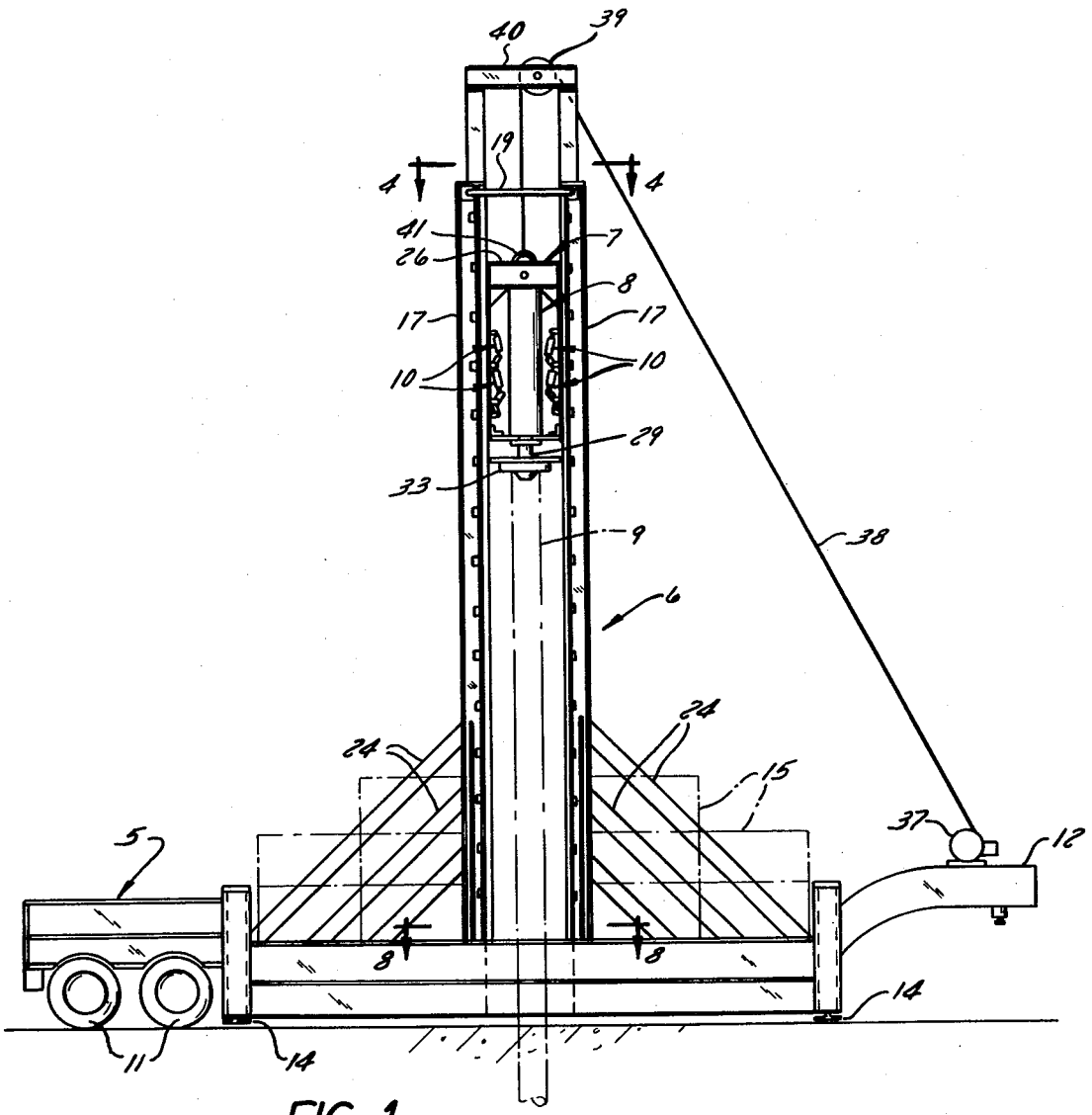
FIG. 1 is a view in side elevation of a non-impact pile driver embodying the principles of this invention.
Figure 2:
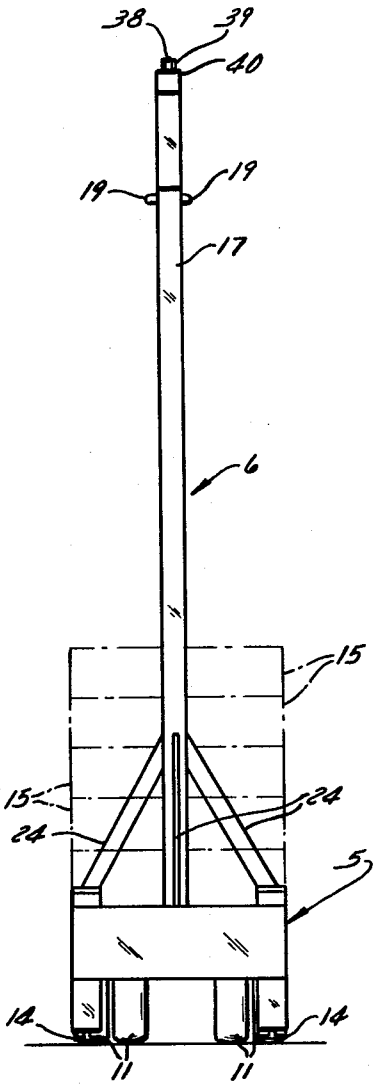
FIG. 2 shows the pile driver in rear elevation.

The non-impact pile driver of this invention is a self-contained unit comprising a sturdy chassis 5 on which an upright mast 6 is secured. A frame-like carriage 7 is slidable vertically along the mast 6 and carries a hydraulic ram 8 whereby downward force is applied to a pile 9 for driving it into the ground. When the ram 8 is operating, the carriage 7 is releasably locked to the mast by latch means 10, as described hereinafter, so that the upward reaction to the downward driving force of the ram is applied to the chassis 5 through its connection with the mast.

For portability of the pile driver, the chassis 5 is preferably a low-boy trailer having wheels 11 at its rear and a hitch neck 12 at its front for connection to a tractor. It will be understood that the mast 6 must have a sturdy and rigid connection to the chassis, but that it is preferably removable for highway transport, inasmuch as the erected mast has a height of over 30 ft. Because of the high reaction forces that it must take, a conventional low-boy chassis is adapted for a pile driver of this invention by installing a second set of longitudinal and transverse beams over those with which it is originally constructed, to double their depth and reinforce them. Sturdy jack pads 14 are installed near the four corners of the chassis, to provide for its stable support on the ground when the machine is in operation.

The reinforcements of the chassis should be arranged to provide it with a flat top surface upon which large concrete blocks or other weights 15 can be piled for increasing its effective weight. The blocks 15 are, of course, removed for highway transport of the chassis.

The mast 6, as here shown, comprises a spaced apart pair of upright wide-flange I-beams 17 that have their bottom ends secured to the chassis and have their top ends connected by parallel spreader bars 19 that bridge across them. Preferably a plurality of diagonal struts 24 extend between the chassis and each of the I-beams 17 to steady and support the mast. The flanges 20 of each I-beam 17 are parallel to those of the other, and the webs 21 of those two beams are coplanar. To the inner flange 20 of each I-beam 17 are secured a pair of spaced apart and parallel angle members 22 that have legs which project towards the other I-beam and cooperate to provide guide rails by which side portions 23 of the carriage 7 are slidably guided.

The carriage 7 is an upright substantially rectangular frame around the cylinder 28 of the ram 8. The side portions 23 of the carriage comprise elongated upright members, on each of which there is an elongated gib 25 that is lengthwise slidably confined between guide rails 22 on one of the I-beams 17. A sturdy transverse header 26 bridges across the tops of the side members 23. At their bottom ends the side members are rigidly connected, as at 27, to a steadying ring **27*a* that closely encircles the lower end portion of the ram cylinder 28, to hold it with its axis vertical and midway between the side members 23. The upper end of the cylinder 28 is rigidly connected to the header 26. The upward reaction force exerted upon the cylinder 28 must be transferred to the side members 23 of the carriage, and from them imposed upon the mast through the latch means 10; hence the header 26 of the carriage has to be particularly strong, and therefore it has substantial depth and its connections to the side members are reinforced by gussets 30. The connections 27 of the cylinder 28 to the side members 23 of the carriage mainly serve to stabilize the ram 8** in relation to the mast.

Bearing in mind that the piston rod 29 has a substantially long stroke—preferably on the order of 60 in.—it is desirable to confine its lower end against lateral deflection. For that purpose there is connected to its lower end a rod guiding element 31 that is elongated transversely to the axis of the hydraulic ram and has end portions 32 that are slidably guided in the guide rails 22. At the underside of this rod guiding element, concentric to the rod 29, is a pile engaging element 33 which has a configuration that depends upon the type of pile to be driven and which is therefore preferably readily removably secured to the rod and the rod guiding elements. In the present case the pile engaging element is illustrated as one for cooperation with pipe-like piles, having a flat peripheral portion 34 that is drivingly engageable with the upper end of a pile and a smaller-radius concentric, frusto-conical boss 35 that projects below the peripheral portion 34 to be received within the upper end portion of the pile and maintain it concentric with the rod 29.

The stroke or travel distance of the piston rod 29 is, of course, substantially shorter than a standard length pile section. The carriage 7 in cooperation with the latch means 10 therefore allows the ram 8 to be moved down step by step as a pile is driven into the ground, since the latch means provides for locking the carriage to the mast at each of a series of locations that are spaced apart vertically by distances shorter than the length of the rod stroke. With the latch means 10 in its releasing position, the carriage is controlledly lowered and raised by means of a winch 37 that is supported on the chassis 5 and is connected with the carriage by means of a cable 38. The winch 37 can be mounted on the hitch neck 12, as shown, or elsewhere on the relatively stationary structure, as for example on one side of the mast. The cable 38 is trained over a pulley 39 that is supported on fixed structure 40 which projects above the top of the mast, and it is connected to an eye 41 on the header 26 of the carriage.

The latch means 10 comprises a pair of vertically spaced apart plunger-like latch members 42 at each side of the carriage, each movable horizontally towards and from locking engagement with abutments 43 on the mast, and a double-acting hydraulic cylinder actuator 44 for each latch member. Each latch member 42 is substantially cylindrical but has a bifurcated rear end portion, and it is slidably confined in closely fitting aligned bores in a side member 23 of the carriage and in the gib 25 adjacent to that side member. The latch actuators 44 and a bell crank 45 that connects each with its latch member 42 are arranged on the laterally inner faces of the carriage side members 23, between the respective side members and the cylinder 28 of the ram 8. Thus for each actuator 44 a laterally inwardly projecting lug 46 is secured as by weldments to a side member 23 of the carriage, and there is a pivotal connection 47 between that lug and the cylinder portion of the actuator, at the end of the latter that is remote from its piston rod 48, so that the actuator can swing laterally in and out about a horizontal axis. Below each actuator 44 a similar lug 49 projects inward from the side member, and to that lower lug 49 is pivoted the bell crank 45. The actuator piston rod 48 is pivotally connected to an upper arm of the bell crank, as at 50, while the lower arm of the bell crank has a lengthwise extending slot 51 in which there is slidingly received a pin 52 that extends transversely through the bell crank and the bifurcated inner end portion of its adjacent latch member.

Each of the abutments 43 on the mast is preferably defined by an annular collar having an inside diameter to slidably receive the latch members 42. Each such collar is received in a closely fitting hole in the inner flange 20 of an I-beam and in a cutout in the web 21 of that beam, and it is welded to the beam to have a very secure connection to it. The collars 43 are spaced apart along the height of the mast by distances equal to the distance between the two latch members 42 at each side of the carriage, typically 24 in. for a ram with a 60 in. stroke.

Figure 3:
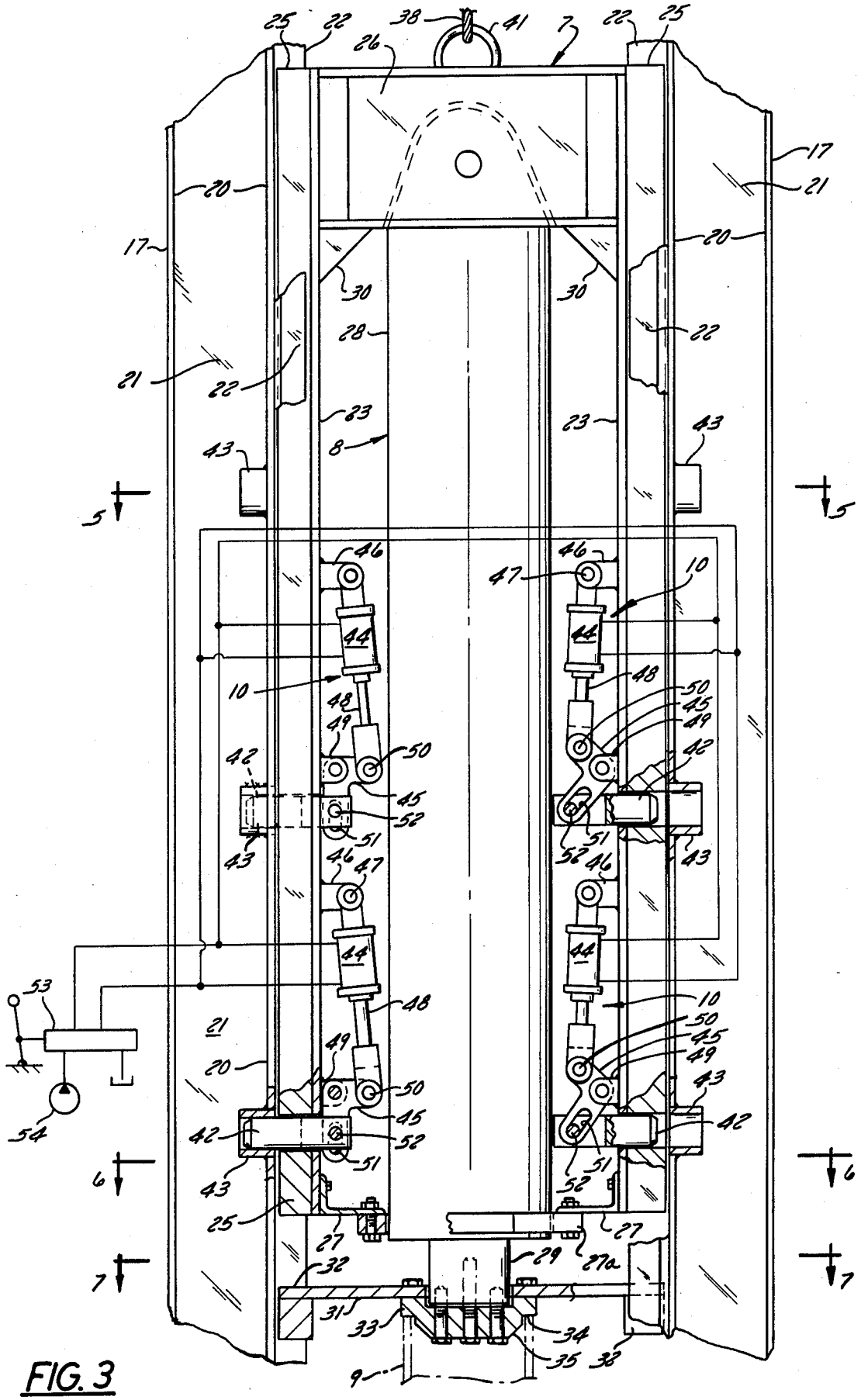
FIG. 3 is a fragmentary view in side elevation, on an enlarged scale, showing the carriage and the ram in relation to the mast.
Figure 4:
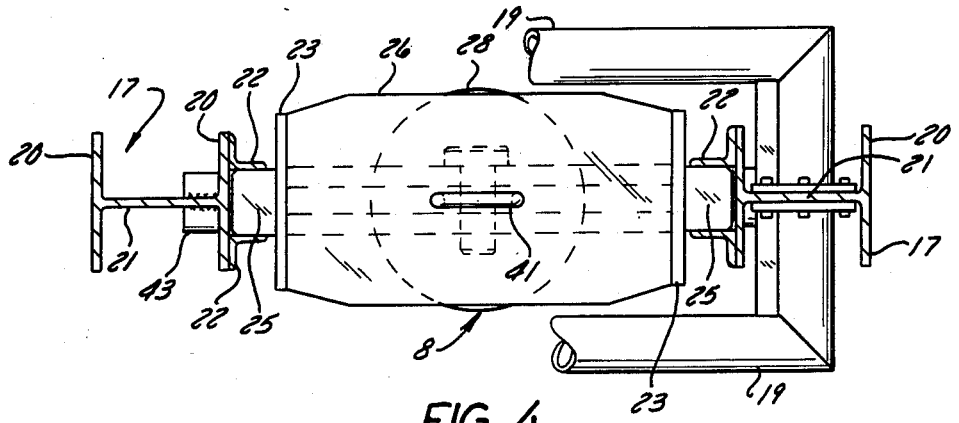
FIG. 4 is a view in horizontal section taken on the plane of the line 4—4 in FIG. 1.
Figure 5:
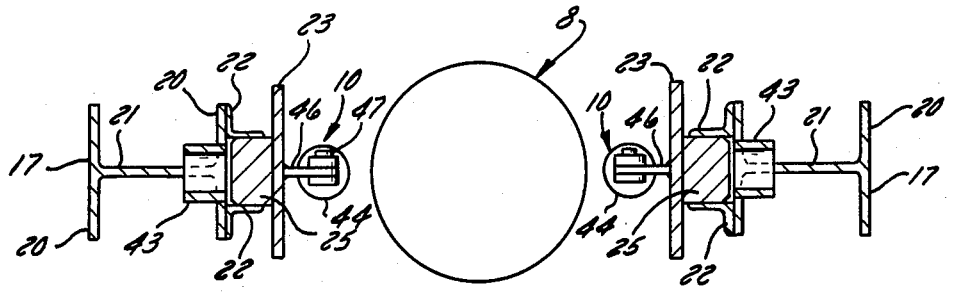
FIGS. 5, 6 and 7 are views in horizontal section, respectively taken on the planes of the lines 5—5, 6—6 and 7—7 in FIG. 3.
Figure 6:
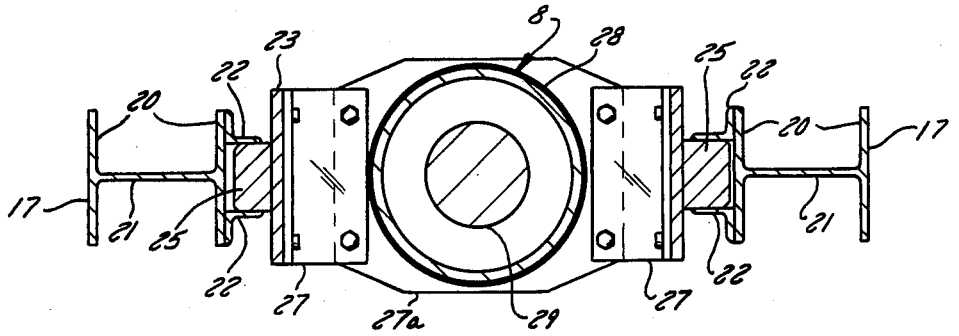
Figure 7:
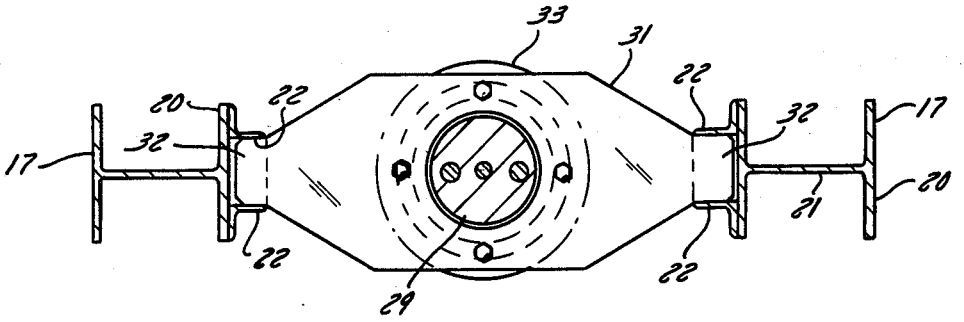

The several hydraulic actuators 44 are all connected, in parallel, with a manually actuatable control valve 53, to provide for simultaneous actuation of the latch members to their latching positions and to their retracted positions; and the control valve 53 is in turn connected with a pump 54 or other source of hydraulic pressure fluid. The control valve 53 is mounted at any convenient location on the chassis at which an operator can observe the operation of the ram 8, and it will be understood that control means (not shown) for the ram and for the winch 37 are also located at the operator's station. For purposes of illustration only, FIG. 3 shows the latch means 10 at the left side of the carriage in locking positions and those at the right side in releasing positions; but it will be understood that all of the latch means are in fact actuated simultaneously to like positions.

In some cases it may be sufficient to provide only one latch member 42 at each side of the carriage 7, but it must be borne in mind that large reaction forces (e.g., on the order of 90 tons) must be transmitted to the mast through the latch members, and therefore the provision of four latch members is desirable from the standpoint of security and stability of the latching connections between the carriage and the mast.

As here shown the mast is mounted on a central portion of the chassis 5. However, the chassis comprises mainly a framework structure and therefore it can be arranged to accommodate the mast either in a central position, as here shown, or at positions adjacent to the side or rear edges of the chassis. With the mast mounted at an edge of the chassis the chassis can be maneuvered to positions that allow piles to be driven in close proximity to the exterior surface of an existing foundation wall, to provide for underpinning that wall either to prevent it from sinking or to repair a sunken condition. At each location at which the mast is to be mountable the frame must have a preferably square opening 57 therethrough, the center of which aligns with the axis of the ram 8.

Figure 8:
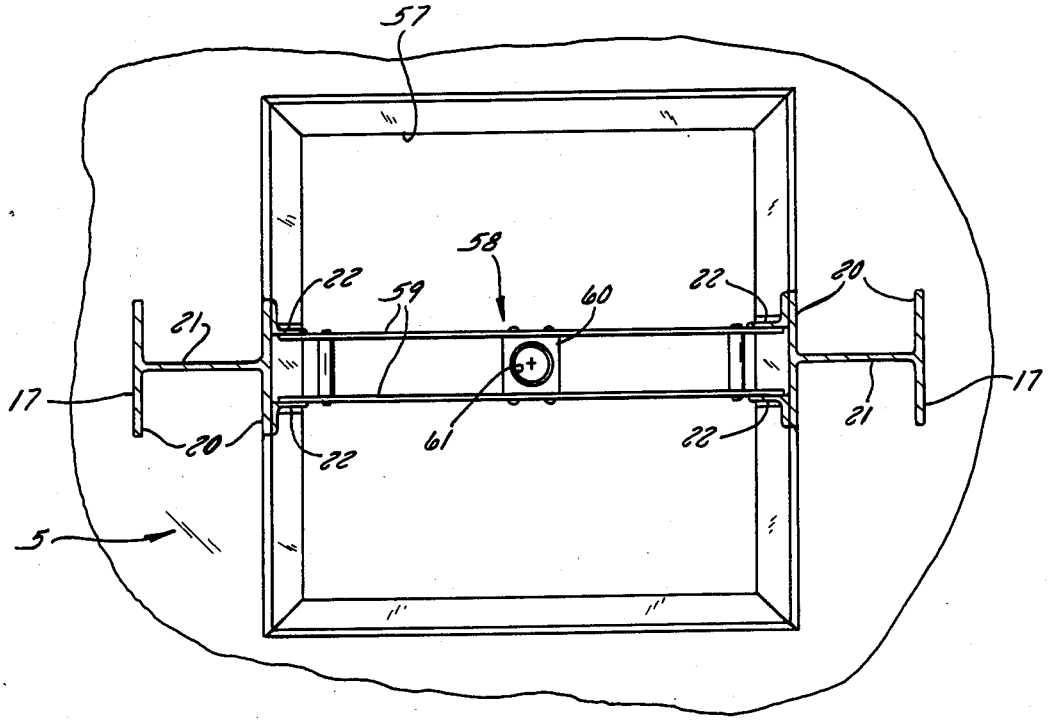
FIG. 8 is a view in horizontal section taken on the plane of the line 8—8 in FIG. 1 and showing a removable boresight device installed for use in accurately siting the chassis.

To enable the chassis to be spotted for driving a pile in exactly a desired position, the ground is marked at the desired center of the pile and a removable boresight device 58 is installed in the frame, as shown in FIG. 8. The boresight device comprises parallel, horizontally extending struts 59 that have their end portions formed to hook onto the chassis frame so that the struts bridge across the opening 57. The two struts 59 cooperate to support a small block 60 that is fastened between them, and they so position the block that a small hole 61 through it has its axis aligned with that of the ram. The chassis, coupled to a suitable tractor, is shifted to bring it to a position in which the mark on the ground is seen to align with the boresight hole 61.

In preparation for driving a pile the boresight device is removed and a pile is set in place, centered in the opening 57 in the frame. A fork lift truck (not shown) can be adapted for initially placing the pile.

Figure 9:
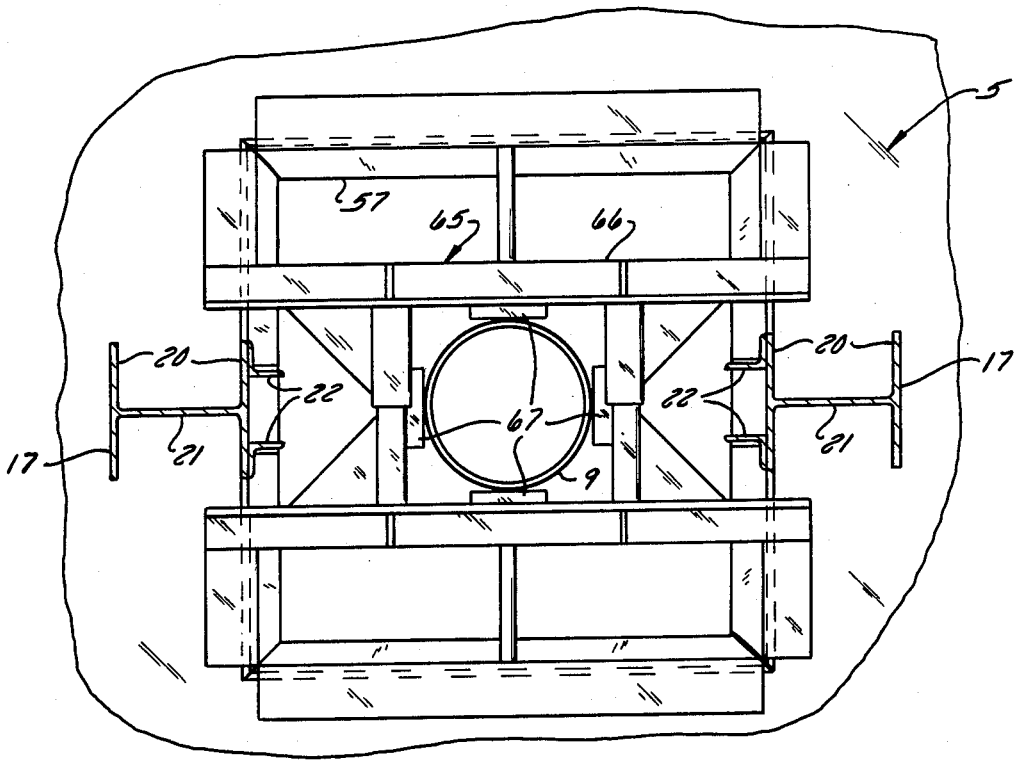
FIG. 9 is a view generally similar to FIG. 8 but showing a removable pile guide in place.

To cooperate with the pile engaging element 33 in steadying the pile during the first stages of its being driven into the ground, a two-piece pile guiding device 65 (FIG. 9) is removably set in place in the opening 57 in the chassis. It comprises a frame 66 that supports four pads 67 which engage the pile at locations around its circumference that are spaced apart by 90° .

As the pile is driven into the ground, the resistance that it exerts can be measured by taking readings of pressure in the hydraulic fluid line connecting the ram with its pressure source. The pile can thus be driven down until it meets a predetermined resistance calculated to be sufficient for supporting its share of the weight of the building.

From the foregoing description taken with the accompanying drawings it will be apparent that this invention provides a nonimpacting pile driver that can drive piling sections of standard length to a depth at which they meet a predetermined resistance and with which the magnitude of that resistance can be readily determined at every stage of the pile driving operation. It will also be apparent that the pile driver of this invention operates with a speed and efficiency comparing favorably with an impacting pile driver but without shocks, vibration and percussive noise of such a machine, to thus be suitable for operation closely adjacent to a building that is in need of repair or in the vicinity of a laboratory, a hospital or the like.

What is claimed as the invention is:

1. A non-impacting pile driver comprising a chassis having ground engaging means for resting on the ground, a mast secured to said chassis and defining a pair of laterally spaced opposite and upright guide rails, a carriage having opposite side portions slidingly engaged with said guide rails to be confined by them to vertical movement along said mast, a hydraulic ram comprising a cylinder fixed to said carriage with its axis upright and between said guide rails and a piston rod projecting downward from said cylinder that is axially extendable and retractable relative to the cylinder and the carriage through a stroke of predetermined length for exerting downward force upon a pile to be driven, and latch means for releasably locking the carriage to the mast at each of a plurality of locations that are spaced apart along the mast by a distances not greater than said predetermined length, said pile driver being characterized by:

A. the cylinder of said hydraulic ram having
  (1) at its upper end an upper connection to the carriage that confines the upper end of the cylinder against lateral motion relative to the carriage and carries upward reaction force upon the cylinder into the carriage for transfer to the mast through said latch means, and
  (2) at its lower end a lower connection with the carriage which cooperates with said upper connection to confine the cylinder against all lateral motion relative to the carriage;

B. the piston rod of said hydraulic ram having guide means fixed on its lower end, said guide means having
  (1) opposite end portions slidingly engaged with said guide rails to confine the piston rod against lateral deflection and
  (2) a pile engaging element on its underside engageable with the top end of a pile to be driven and arranged to confine the same against lateral displacement relative to the piston rod.

2. The non-impacting pile driver of claim 1 further characterized in that: said pile engaging element comprises a downwardly projecting boss receivable in the upper end portion of a pipe pile and surrounded by a flat downwardly facing surface for engaging the top end of the pipe pile.

3. The non-impacting pile driver of claim 1, further characterized by:

(1) said carriage comprising
  (a) a transversely extending header to which said cylinder has its said upper connection and
  (b) a pair of opposite elongated side portions projecting down from said header, each slidingly engaged with one of said guide rails and to the lower ends of which said cylinder has its lower connection;

(2) said latch means comprising
  (a) at least one latch member adjacent to each of said side portions of the carriage, each said latch member being movable horizontally to and from an extended position, and
  (b) means on said mast defining a plurality of abutments adjacent to each said guide rail, each said abutment being engageable by one of said latch members in the extended position of the latch member to cooperate with that latch member in confining the carriage against upward displacement, the abutments adjacent to each guide rail being spaced along the same at said distance; and (3) actuating means connected between the carriage and each of said latch members for actuating the latch members substantially in unison, alternatively and selectably to their extended positions and away from their extended positions to retracted positions clear of said abutments.

4. The non-impacting pile driver of claim 3, further characterized by:

(4) a winch supported on said chassis and having a connection with said carriage for raising and controlledly lowering the carriage when said latch members are in their retracted positions.

5. The non-impacting pile driver of claim 1 wherein said chassis has a substantially flat top surface of substantial area upon which weights can be placed to resist the upward reaction to downward force exerted through the piston rod.

6. The non-impacting pile driver of claim 1 wherein said chassis has an opening therein that is between said guide rails, has horizontal dimensions substantially greater than the diameter of a pile to be driven, and has its center substantially aligned with the axis of said hydraulic ram, further characterized by:

C. a pile guiding device in said opening, arranged to be removably supported by the chassis and confined thereby against horizontal displacement, said pile guiding device
  (1) comprising a plurality of parts, each of which is arranged to embrace a pile around a substantial portion of its circumference and
  (2) having thereon a plurality of pad surfaces arranged to slidingly engage a pile embraced by said device at circumferentially spaced locations around the pile to maintain the embraced portion of the pile coaxial with the ram.

* * * * *